US006435768B1

(12) United States Patent
Mansfield

(10) Patent No.: US 6,435,768 B1
(45) Date of Patent: Aug. 20, 2002

(54) BOAT LIFT APPARATUS

(76) Inventor: Peter W. Mansfield, P.O. Box 338, Urbanna, VA (US) 23175-0338

( * ) Notice: Subject to any disclaimer, the term of this patent is extended or adjusted under 35 U.S.C. 154(b) by 0 days.

(21) Appl. No.: 09/832,567

(22) Filed: Apr. 11, 2001

(51) Int. Cl.[7] ..... B63C 3/06; B63C 7/00
(52) U.S. Cl. ..... 405/3; 114/44; 414/678
(58) Field of Search ..... 405/3, 218, 219; 114/44, 45, 48; 414/678

(56) References Cited

U.S. PATENT DOCUMENTS

| | | | | | |
|---|---|---|---|---|---|
| 5,378,082 | A | | 1/1995 | Hiller et al. | 405/3 |
| 5,482,401 | A | * | 1/1996 | Spisak | 114/44 |
| 5,593,247 | A | | 1/1997 | Endres et al. | 405/3 |
| 5,628,583 | A | | 5/1997 | Gibson | 405/3 |
| 5,772,360 | A | | 6/1998 | Wood, II | 405/3 |
| 5,810,508 | A | * | 9/1998 | Norfolk et al. | 114/44 |
| 5,839,851 | A | | 11/1998 | Norfolk et al. | 405/3 |
| 5,934,826 | A | | 8/1999 | Mansfield | 405/3 |
| 6,033,148 | A | * | 3/2000 | Norfolk et al. | 114/44 |

* cited by examiner

*Primary Examiner*—Thomas B. Will
*Assistant Examiner*—Tara L. Mayo
(74) *Attorney, Agent, or Firm*—Charles J. Prescott

(57) ABSTRACT

A boat lift apparatus connectable to a tubular piling to form a piling assembly embeddable into a bottom of a body of water. The apparatus includes a gearbox with a first worm gear arrangement driven by a motor output shaft and a second worm gear arrangement oriented orthogonally to the first worm gear arrangement within the gearbox. The second worm gear arrangement includes a support shaft which may drive a cable drum which is rotational driven from the second support shaft to withdraw and extend a length of cable therefrom to raise and lower a boat.

19 Claims, 16 Drawing Sheets

290
288b
296
298
299
294

290
306
300
282
304
308
302
292
288b
294
290

288
280
296
282
284
310
286
312
316
285
314
288a
318

BOAT LIFT APPARATUS

BACKGROUND OF THE INVENTION

1. Scope of Invention

This invention relates generally to pilings and boat lifts supported on pilings and docks, and more particularly to unique boat lift apparatus connectable to, and preferably fully enclosed within an upper portion of a hollow tubular piling.

2. Prior Art

Pilings for supporting a dock and for providing a support and tie-off for boats are typically made of elongated wooden poles, called pilings, for economy. These wooden pilings may be treated in various ways to enhance the useful life thereof.

The following U.S. patents are known to applicant which generally teach the state-of-the-art in conventional pilings for boat lift apparatus as follows:

U.S. Pat. No. 5,772,360 to Wood, II

U.S. Pat. No. 5,839,851 to Norfolk, et al.

U.S. Pat. No. 5,593,247 to Endres, et al.

U.S. Pat. No. 5,378,082 to Hiller, et al.

U.S. Pat. No. 5,628,583 to Gibson

Disclosed within a recent patent by applicant in U.S. Pat. No. 5,934,826 is an improved boat lift apparatus which utilizes inert plastic such as p.v.c to form an upright reinforced tubular piling having significant advantages of economy, longevity and ease of installation over conventional wooden pilings.

The present invention utilizes the advantages of hollow tubular plastic pilings having concrete reinforced lower portions which receive support from the bottom of a body of water by providing an improved boat lift apparatus which is connectable, in its preferred embodiment, within the hollow upper portion of such tubular pilings. The present invention provides full concealment within the hollow tubular piling, while providing superior mechanical advantage through utilization of a unique double worm gear arrangement for force multiplication in lifting, lowering and holding the position of a boat.

BRIEF SUMMARY OF THE INVENTION

This invention is directed to a boat lift apparatus connectable preferably to an elongated tubular piling, a lower portion of the tubular piling receiving support when embedded into a bottom of a body of water. The apparatus includes a motor connected to a gearbox and having an output shaft. A first worm gear arrangement includes a first worm and a first worm gear, the first worm rigidly connected coaxially on the output shaft and drivingly engaged with the first worm gear which is rigidly connected on a first support shaft oriented orthogonally to the output shaft and held for rotation only by the gearbox. An auxiliary thrust bearing is placed between the gearbox and the first worm. A second worm gear set includes a second worm and a second worm gear spaced from the first worm gear set but with the second worm rigidly connected on the first support shaft. The second worm is drivingly engaged with the second worm gear which is rigidly connected on a second support shaft oriented orthogonally to the first support shaft and held for rotation only by the gearbox. A preferred feature is a thrust member positioned on the motor output shaft which transfers one-directional thrust to the motor housing. The invention may also include one or more cable drums having lengths of wrapped cable that may be mounted for rotation on additional support shafts connected to an elongated frame and oriented substantially parallel to the second support shaft, the frame being connected to the gearbox. The cable drums are operably connected to, and rotationally driven from, the second support shaft responsive to rotational output of the output shaft to withdraw and extend the cable on the cable drum.

It is therefore an object of this invention to provide a boat lift apparatus having no visible portion thereof such as a motor, gearbox, cables or controls, all of which are concealed within a hollow tubular piling.

It is another object of this invention to provide a boat lift apparatus with significantly superior weight-lifting capabilities over those conventional prior art apparatus of a similar overall size, weight and cost.

It is still another object of this invention to provide a boat lift mechanism which is self-locking and will not back drift or spool outwardly when power to the motor is removed.

It is yet another object of this invention to provide a boat lift apparatus which may be connectable atop an existing conventional piling without the need for piling replacement.

Still another object of this invention is to provide a boat lift apparatus which is connectable onto an existing dock or overhead boat lift structure without the need for modification thereof.

Another object of this invention is to provide a portable boat lift apparatus which is operable by the utilization of a separate battery-powered drill or other rotary output device.

It is still another object of this invention to provide a uniquely structured cable drum for use in conjunction with a boat lift apparatus which provides superior cable winding features and cable longevity.

A yet further object is the transfer of worm/worm gear one-directional thrust directly to the motor housing so as to preserve the integrity of the motor bearings which are not typically designed to absorb axial thrust.

In accordance with these and other objects which will become apparent hereinafter, the instant invention will now be described with reference to the accompanying drawings.

DETAILED DESCRIPTION OF THE INVENTION

Figure 1A:
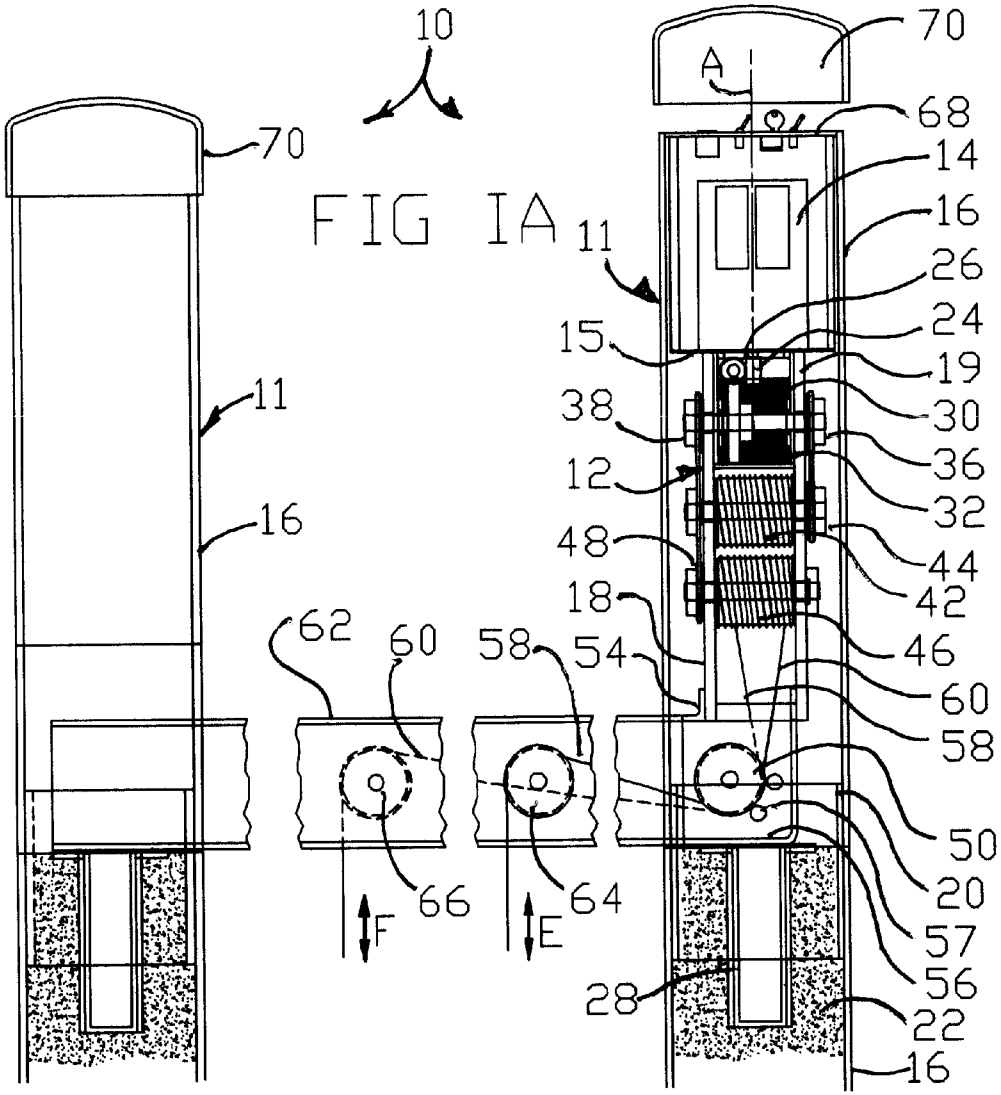
FIG. 1A is a front elevation schematic view of one embodiment of the invention incorporated into a two-piling boat lift arrangement.

Referring now to the drawings and particularly to FIGS. 1A to 4B, a piling assembly of the invention is shown generally in one embodiment at numeral 11 incorporated into a boat lift system shown generally at numeral 10. The system 10 includes, in this embodiment, two spaced apart piling assemblies 11 each including a tubular piling 16 embedded into the bottom of a body of water and reinforced with poured concrete 22 filling the lower portion of each of the tubular pilings 16. See previous U.S. Pat. Nos. 5,934,826 and 6,224,294, for details of tubular p.v.c. plastic pilings and their mode of installation.

More specifically, the drive apparatus of the invention is shown generally at numeral 12 positioned and fully concealed within each of the tubular pilings 16. The apparatus 12 generally includes a drive motor 14, preferably of an induction type and rotational power output in the range of ½ to 1½ hp. The motor 14 has an output shaft for rotational output along longitudinal axis A onto which output shaft a first worm 24 is rigidly connected. The motor 14 is rigidly bolted to an adaptor plate 15 which, in turn, is bolted to top of a gearbox 19.

The rectangular elongated hollow gearbox 19 is connected at its upper end to the adapter plate 15. Connected within the gearbox 19 and supported for rotation only is a first support shaft 27 mounted within the gearbox 19 about horizontal axis G. A first worm gear 25 is rigidly connected to the first support shaft 27 and drivingly engaged with first worm 24 which drivingly rotates the first worm gear 25 and first support shaft 27 responsive to driving rotation of the motor 14. This rotation also creates a thrust axially upward with respect to the motor axis A which is distributed from the upper end of the worm 24 to the housing 14*a* in FIGS. 4C and 4D of the motor 14 through a thrust bearing 23 between the motor 14 and first worm 24.

A second worm 26 is rigidly connected on the first support shaft 27 at a position spaced from the first worm gear 25. A second worm gear 30 is rigidly connected to a second support shaft 29 supported for rotation only within gearbox 19 about horizontal axis B which is orthogonal to axis G, axis G being orthogonally oriented to axis A, the longitudinal axis of rotation of motor 14.

The second worm gear 30, rigidly connected at a mid point along the length of the second support shaft 29, is drivingly engaged by second worm 26. An oil fill partition 40 forms an oil dam or reservoir with the sidewalls of gearbox 19 so that a quantity of oil 32 will serve as an oil bath for the entire dual worm gear arrangement by the at least partial emersion of the first worm gear 24 therewithin.

Sprockets 36 and 38 are rigidly connected at the corresponding opposite ends of the second support shaft 29. Each of these sprockets 36 and 38 are connected by an endless chain or belt 37 and 39, respectively, to sprockets 44 and 48, respectively, of cable drums 42 and 46, respectively.

Figure 4:
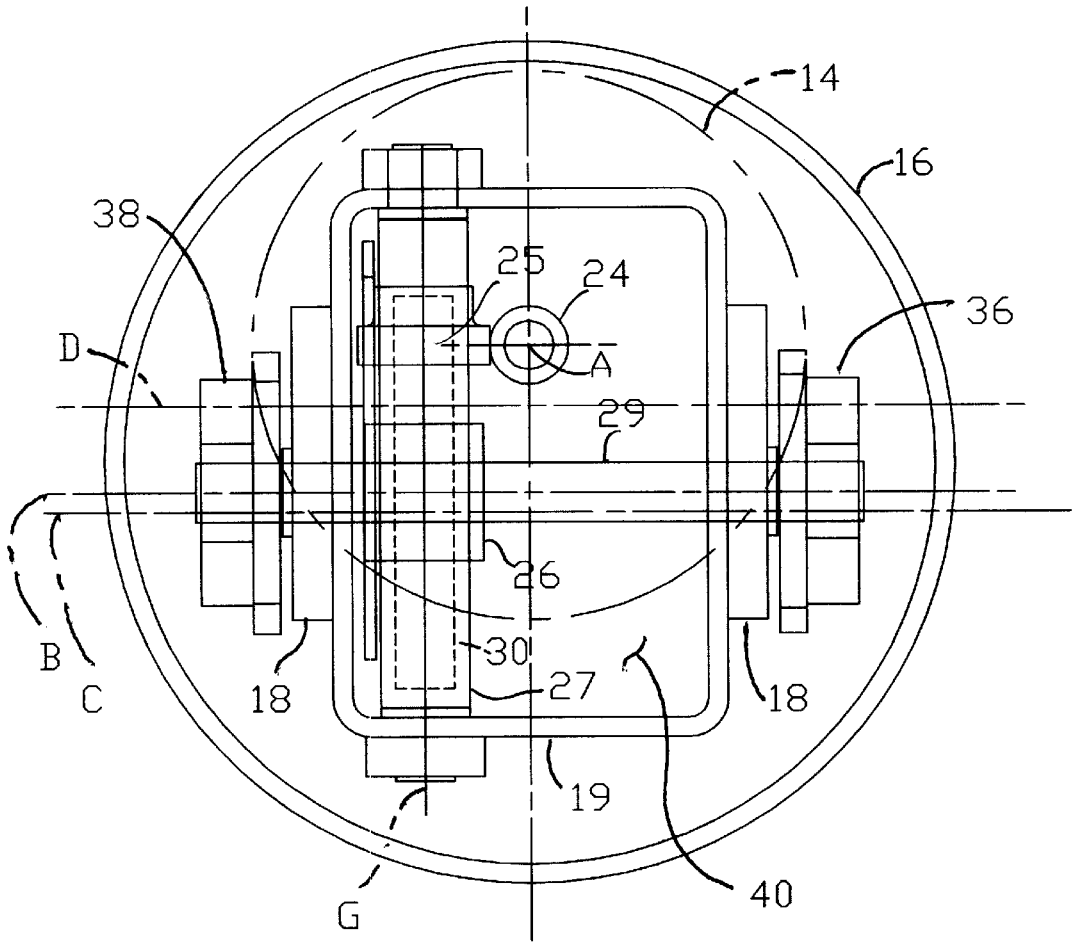
FIG. 4 is a top plan view of FIG. 3 with the protective cap removed and showing the motor in phantom for clarity.
Figure 4A:
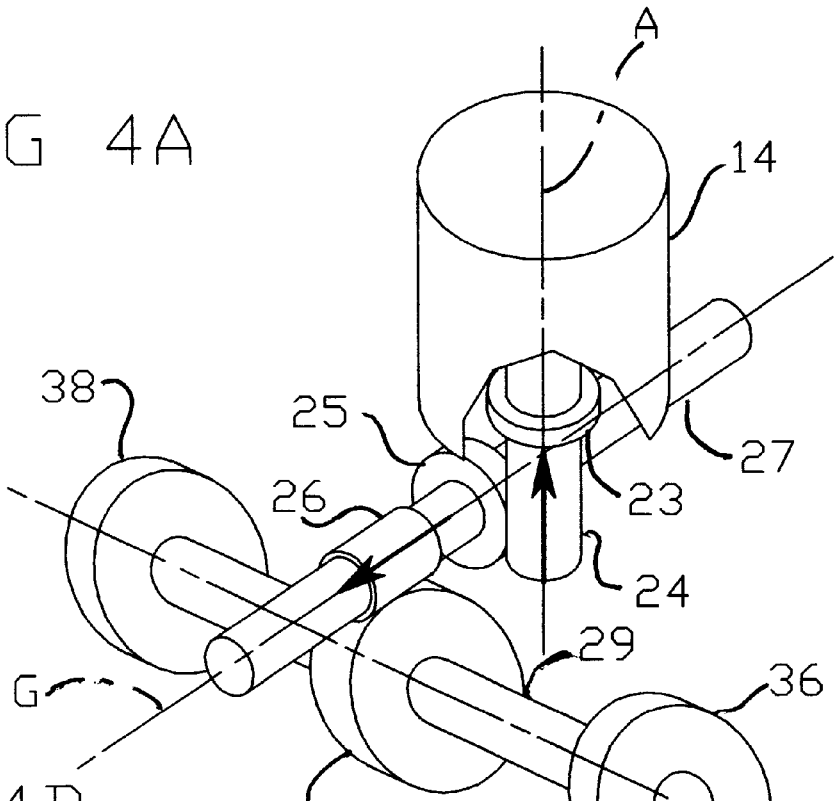
FIG. 4A is a perspective schematic view of the preferred embodiment of the double worm gear arrangement of the invention.
Figure 4B:
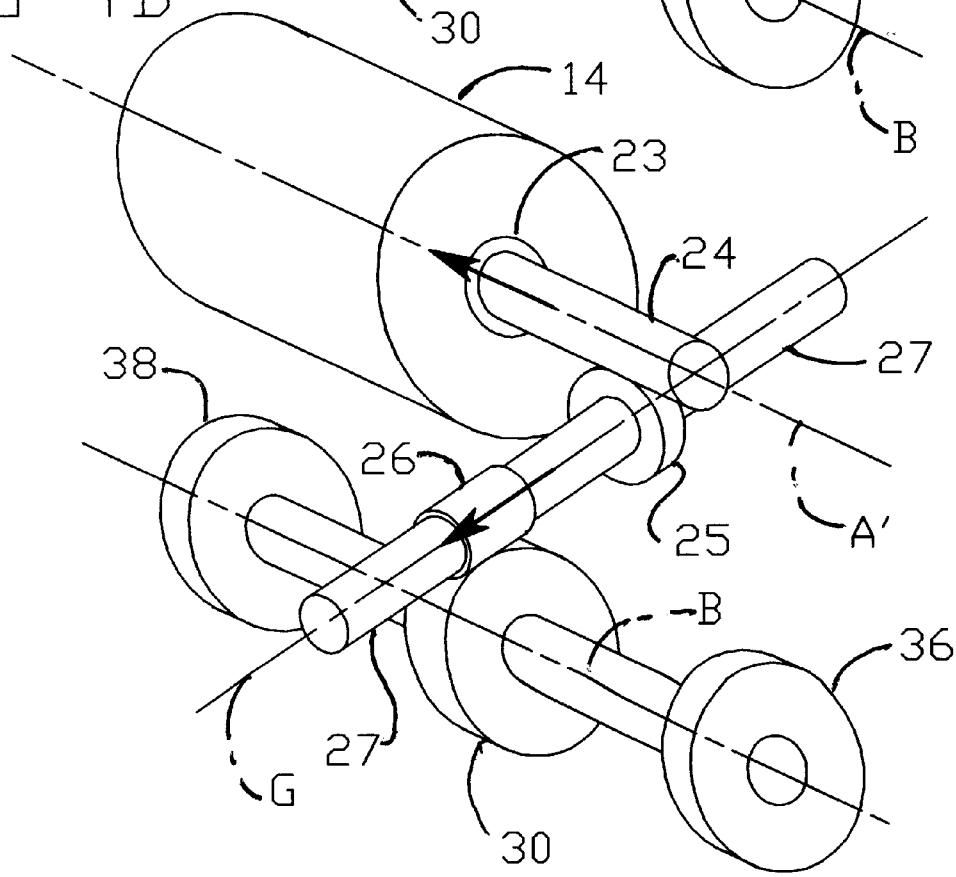
FIG. 4B is a view similar to FIG. 4A showing an alternate orientation of the drive motor.

An important essence of the invention, therefore, is the utilization of an induction motor 14 to drivingly rotate a dual worm gear arrangement as best seen schematically in perspective in FIGS. 4A and 4B. Note that the longitudinal axis A of the motor 14 and the first worm 24 may be oriented at any convenient angle with respect to the upright piling as desired; however, the upright orientation shown in FIG. 4A is preferred for concealment and packaging purposes within the hollow upper end of each tubular piling 16.

DETAILS OF PREFERRED EMBODIMENT

Figure 4C:
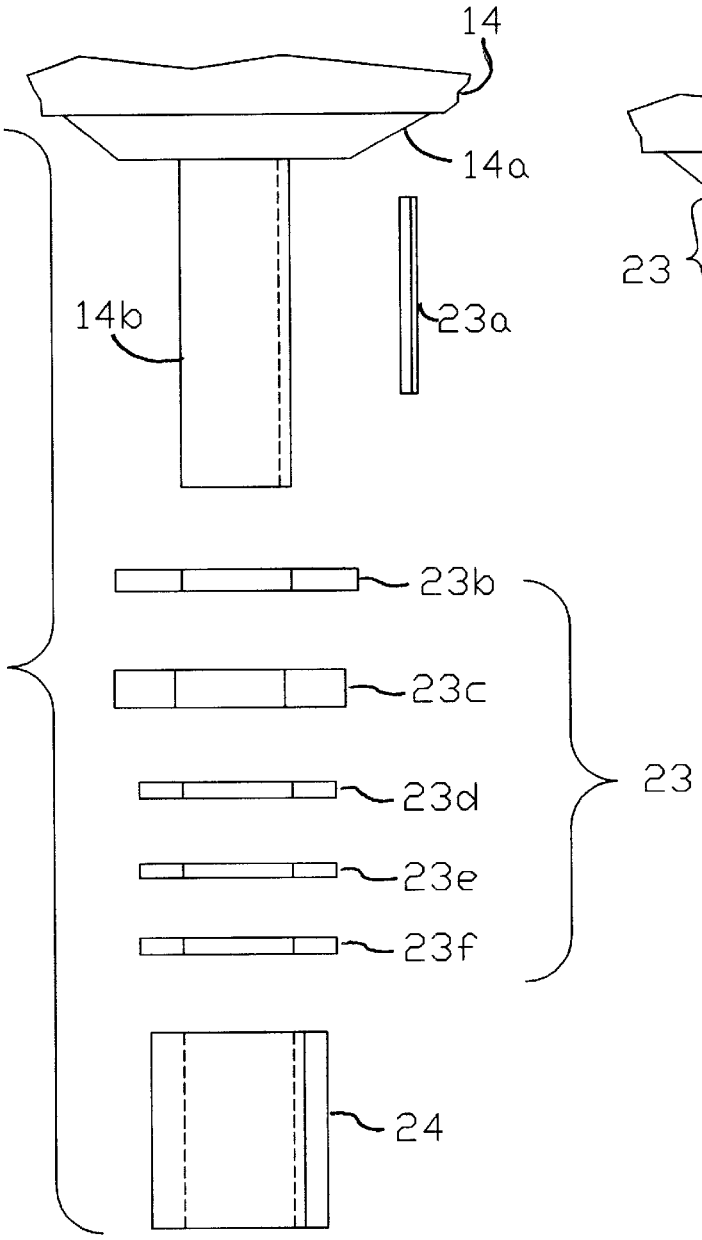
FIG. 4C is an enlarged exploded view of the output shaft of the motor, the first worm, and the intermediate thrust member.
Figure 4D:
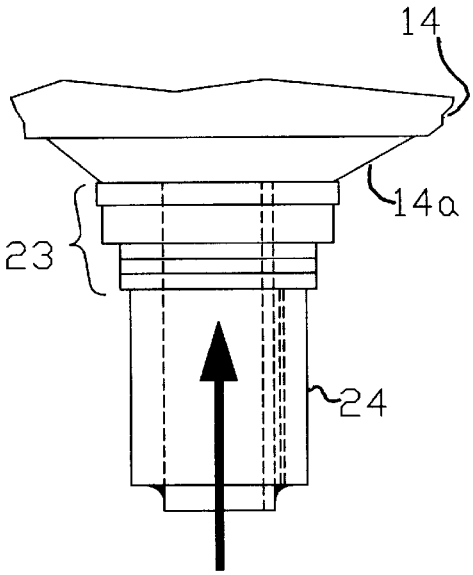
FIG. 4D is an assembled view of FIG. 4C.

In one preferred embodiment of this invention, the first worm 24 is a twelve-pitch, single, two or four start worm, resulting in motor input speed reductions of 5, 10 and 20 to 1 when engaged with the first worm gear 25 having a twelve-pitch, twenty-tooth design. A thrust bearing 23 as best seen in FIGS. 4B and 4C is connected between the motor housing 14*a* and the first worm 24 to eliminate thrust against the motor 14 bearings (not shown) which are not normally constructed to dissipate thrust loads. The high thrust load results as lifting load is applied and occurs only in one direction as indicated by the arrow in FIGS. 4A, 4B, 4C and 4D, the direction of thrust determined by the direction of rotation of the motor and worm gear selection. The preferred embodiment of the thrust bearing 23 includes spacers 23*b* and 23*c* and braces 23*d* and 23*f* which are positioned on either side of a thrust bearing 23*e*. A key 26*a* lockably engages with the worm 24 to secure from rotation with respect to output shaft 14*b*. By this arrangement, all axial thrust in the direction of the arrow in FIG. 4D is transferred into the housing 14*a* of motor 14 such that the internal bearings of the motor 14 are substantially unstressed by this axial thrust force not normally encountered by a conventional motor design. The second worm 26 is an eight-pitch, single-lead worm which drivingly engages the second worm gear 30 which is also of a twelve-pitch, forty-tooth design. Axial thrust along axis G is dissipated by the gearbox 19 also. Sprockets 36 and 38 are a #50–18 tooth design, which is also used for sprockets 44 and 48.

Figure 1B:
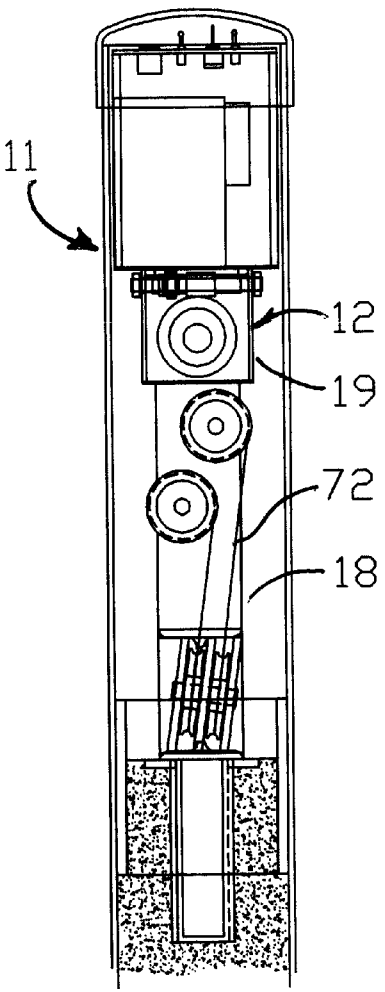
FIG. 1B is a right side elevation partially exploded view of FIG. 1A.

The control circuitry panel is generally shown at 68 in FIGS. 1A and 1B and is of a conventional nature. A removable pvc cover 70 is utilized to enclose the upper end of the tubular piling member 16 and all associated components of the drive apparatus 12. A slack cable support 72 is provided, along with a low voltage reed switch cable follower 76, both of which are described herebelow.

Figure 2:
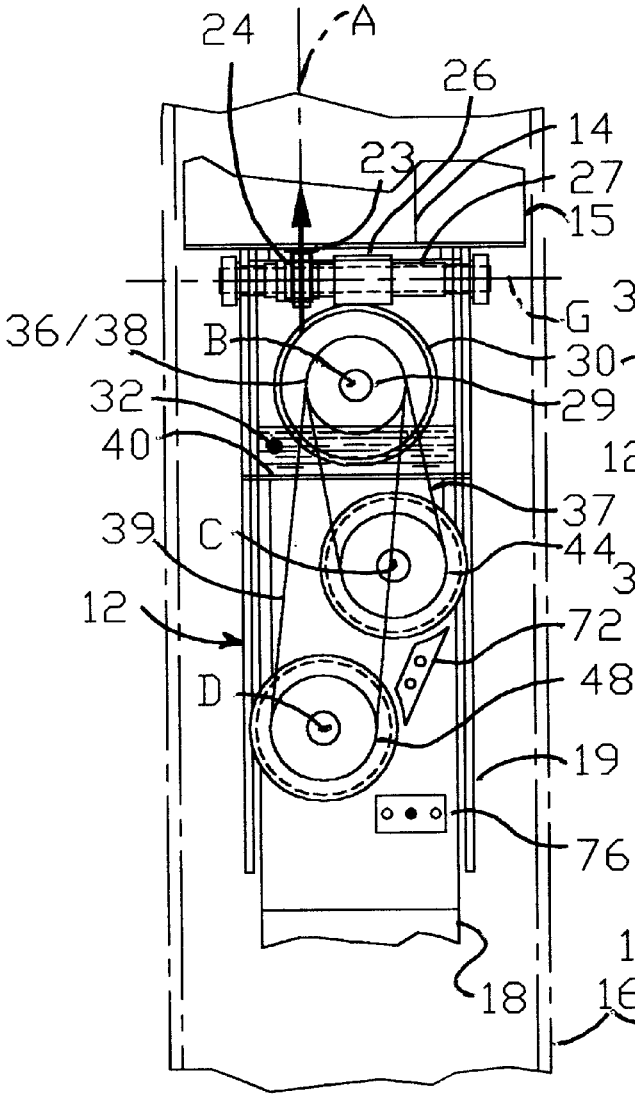
FIG. 2 is an enlargement of the central portion of the invention as shown in FIG. 1A.
Figure 3:
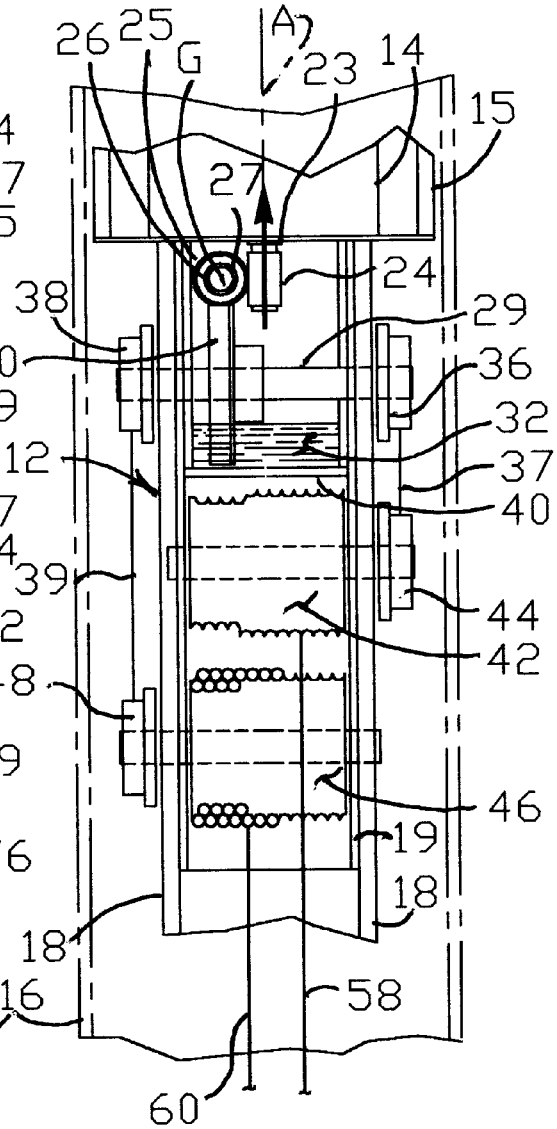
FIG. 3 is an enlargement of the central portion of the invention as shown in FIG. 1B.
Figure 5:
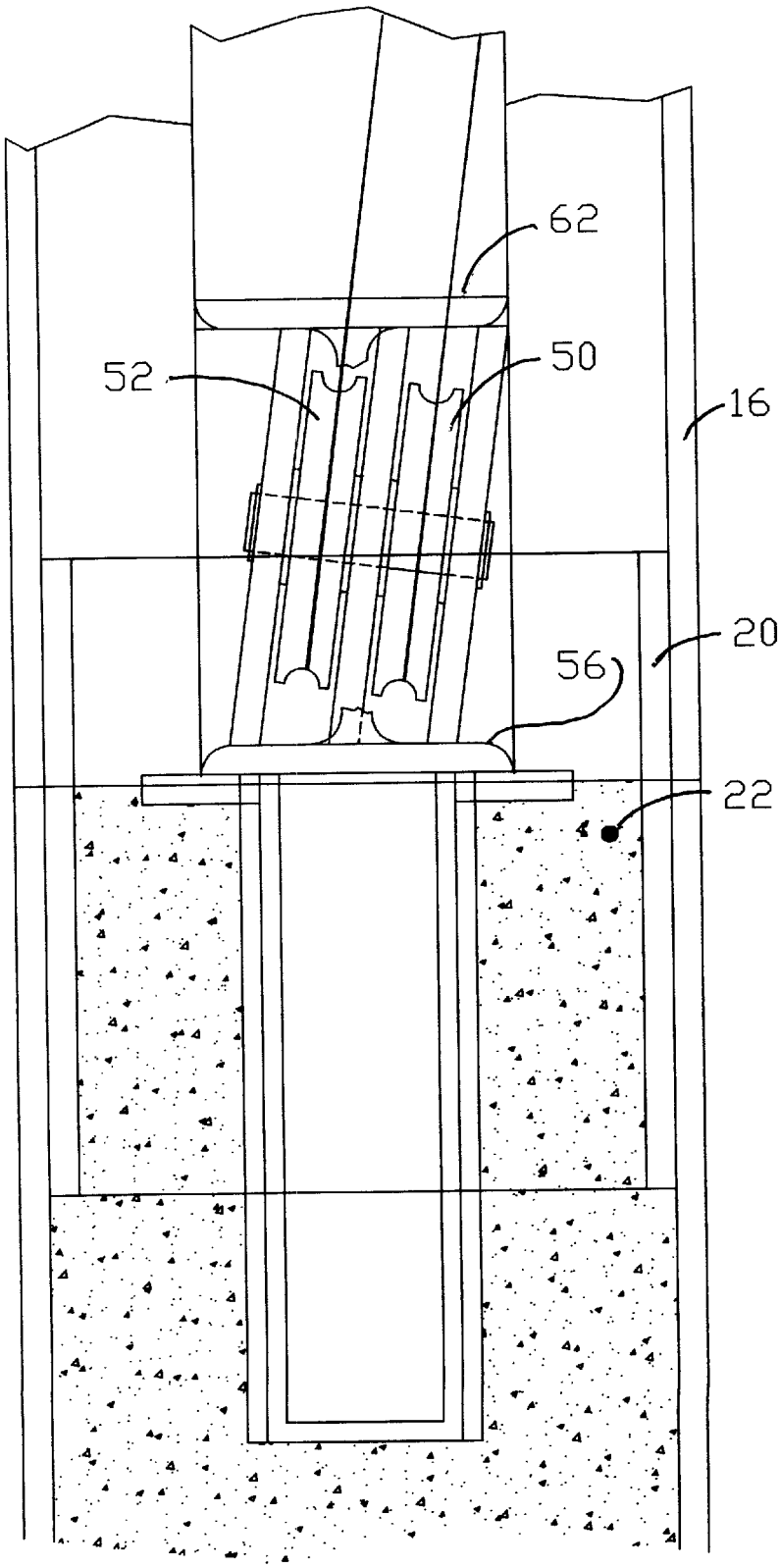
FIG. 5 is an enlarged view of the lower pulley arrangement shown in FIG. 1A.

Note, as best seen in FIG. 2, that the axes C and D of the cable drums 42 and 46, respectively, are horizontally offset to avoid rubbing contact and frictional interference between the respective cables 58 and 60 as they extend between the cable drums 42 and 46 and the change of direction pulleys 50 and 52 as seen in FIG. 5. The pulleys 50 and 52 are rigidly connected to the upper surface of the concrete 22 within a rectangular channel member 62 on I-beams 54 as shown. A slack cable adjustment support 56 is provided for the intended purpose.

Note also that gearbox 19 is itself additionally supported by elongated upright support plates 18 which are connected to, the outer surfaces of two opposing sides of the frame 19 as best seen in FIG. 1B, and which extend downwardly to an elongated overhead boat lift beam 62. As seen in to FIG. 5, each cable 58 and 60 extends downwardly from the corresponding cable drums 42 and 46, respectively, to engage around pulleys 50 and 52 mounted within the mid portion of the tubular piling 16 and against the upper end of the cured concrete 22 for additional support. These pulleys 50 and 52 serve to turn the cables 58 and 60 directionally to extend from within the tubular piling 16. Two additional directional change pulleys 64 and 66, respectively, are mounted for rotation only on the overhead beam 62. The cables 58, and 60 then extend downwardly from each of the respective pulleys 64 and 66 for controlled movement in the direction of arrows E and F to lift and lower a boat cradle and boat thereon (not shown) responsive to rotational output from the motor 14 as regulated by control panel 68 upon the removal of cap 70.

Figure 6:
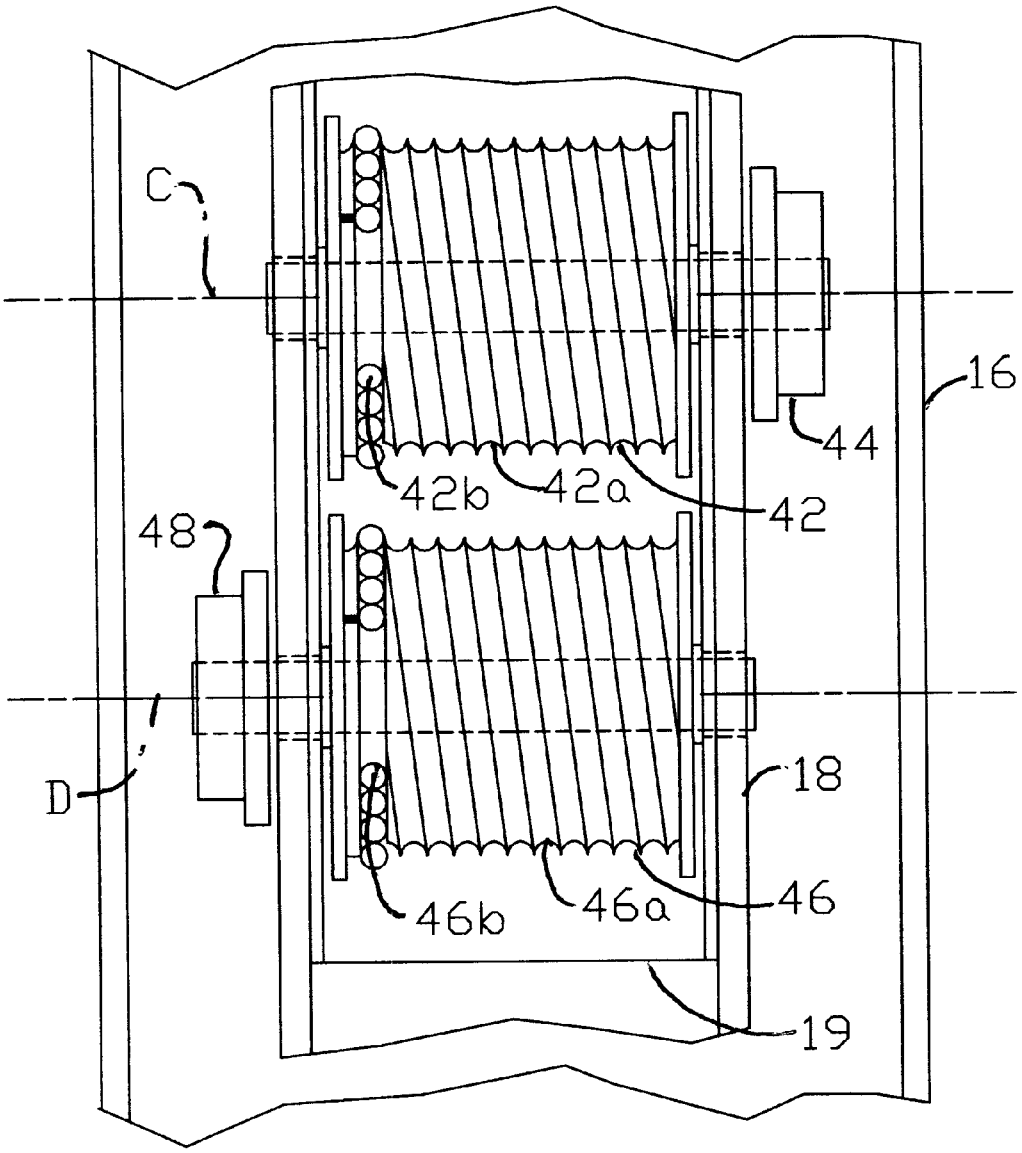
FIG. 6 is an enlargement of the dual cable drum arrangement shown in FIG. 1B.

Turning now to FIG. 6, the unique structure of each of the cable drums 42 and 46 of this invention is there shown. A first set of cable grooves 42*b* and 46*b* are utilized as static cable wraps, preferably 4 in number. A second set of cable grooves 42*a* and 46*a* are provided to serve as support and alignment for the active portion of the cable wrapping. Thus, the static wraps 42*b* and 46*b* receive 4 turns of cable wrapped around each of these first cable set grooves 42*b* and 46*b*, after which each cable then is wound atop these static cable turns in a staggered or laterally offset fashion as shown and continue on to the second cable groove sets 42*a* and 46*a*. By this arrangement, the active cable wrapped on the second cable groove set 42*a* and 46*a* is continuous over the static cable wrapped on the first cable grooves 42*b* and 46*b*.

Sizing each of the cable drums to have a nominal active diameter of 4½", fifteen turns of active cable provide approximately 18' of useable active cable or an 18' lift and drop, respectively, using a single-part line and one-half of that if a two-part line is utilized for additional mechanical advantage.

Figure 7:
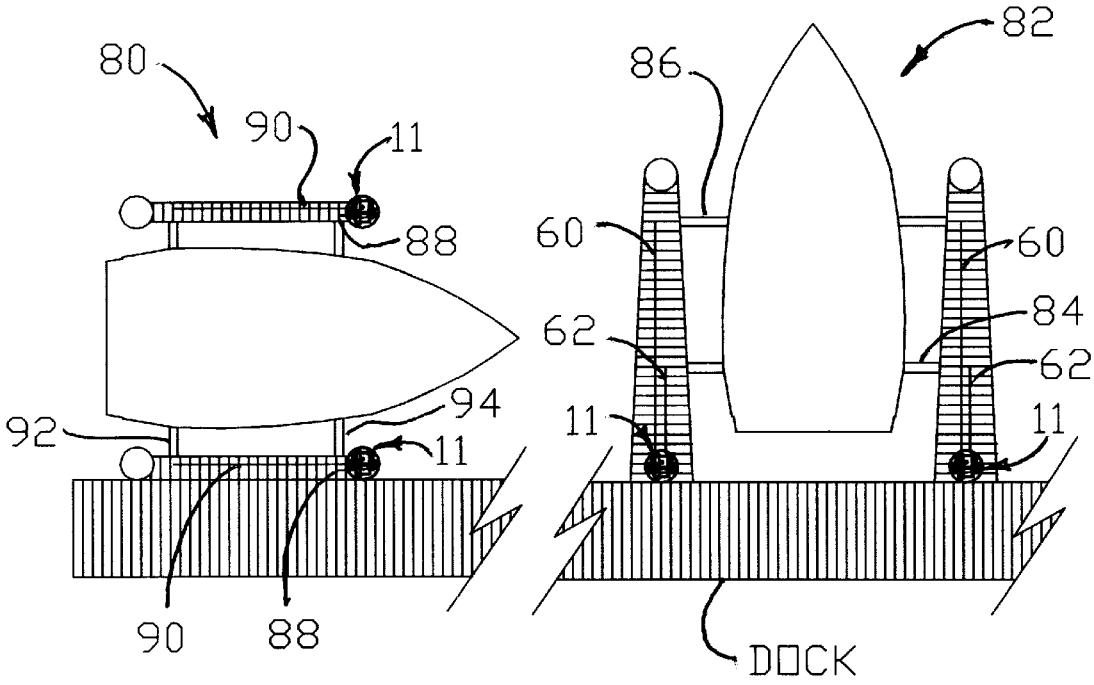
FIG. 7 is a top plan view of two embodiments of a dock and boat lifts utilizing the present invention.

Turning to FIG. 7, two alternate embodiments 80 and 82 for utilizing the present invention 12 within piling assemblies 11 as above described are thereshown. In FIG. 7, one arrangement is shown at numeral 80 wherein a boat is supported by one piling assembly 11 attached to the dock, while another of the piling assemblies 11 is utilized in an offset fashion from the dock. Cables 88 and 90 serve to lift boat support beams 92 and 94 as regulated and controlled by the boat lift apparatus 12 within each of the piling assemblies 11 as above described. Another arrangement shown in FIG. 7 at numeral 82 utilizes two piling assemblies 11 positioned at the edge of the dock and at the proximal ends of finger piers, each controlling boat support beams 84 and 86, respectively, by movement of cables 60 and 62 in a manner above described.

Figure 8:
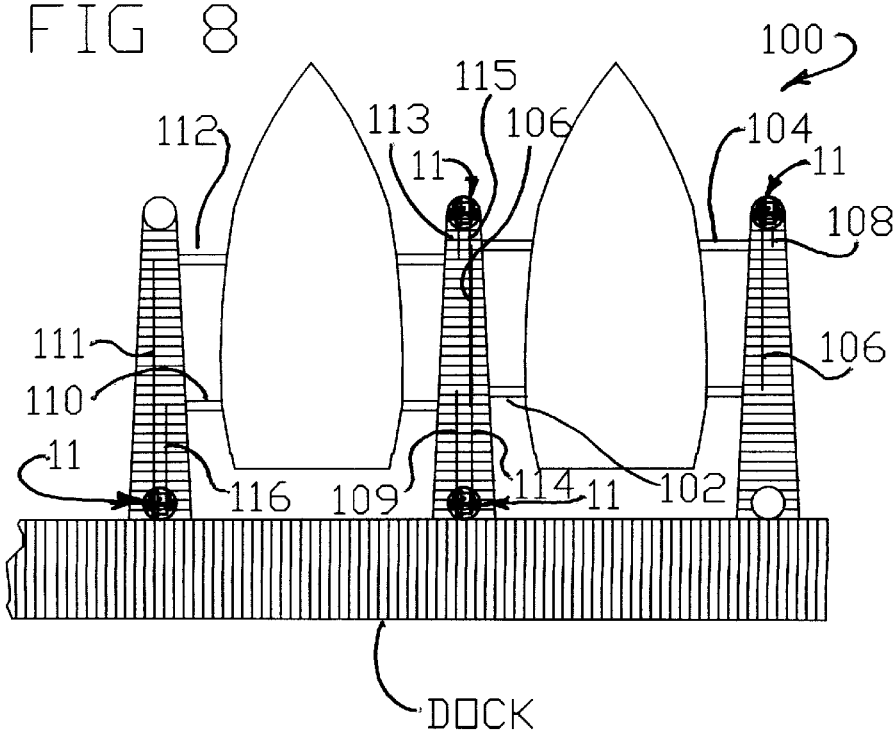
FIG. 8 is a top plan view of another dock and pier arrangement utilizing the present invention to lift multiple boats as in a marina.

In FIG. 8, yet another embodiment of a boat dock is shown at numeral 100 utilizing a total of four piling assembles 11. Cables 106, 108, 109 and 114 lift boat supports 102 and 104 in unison to lift and lower the boat in place thereon, while cables 111, 113, 115 and 116 independently raise and lower boat beams 110 and 112 in a fashion as above described.

Figure 9:
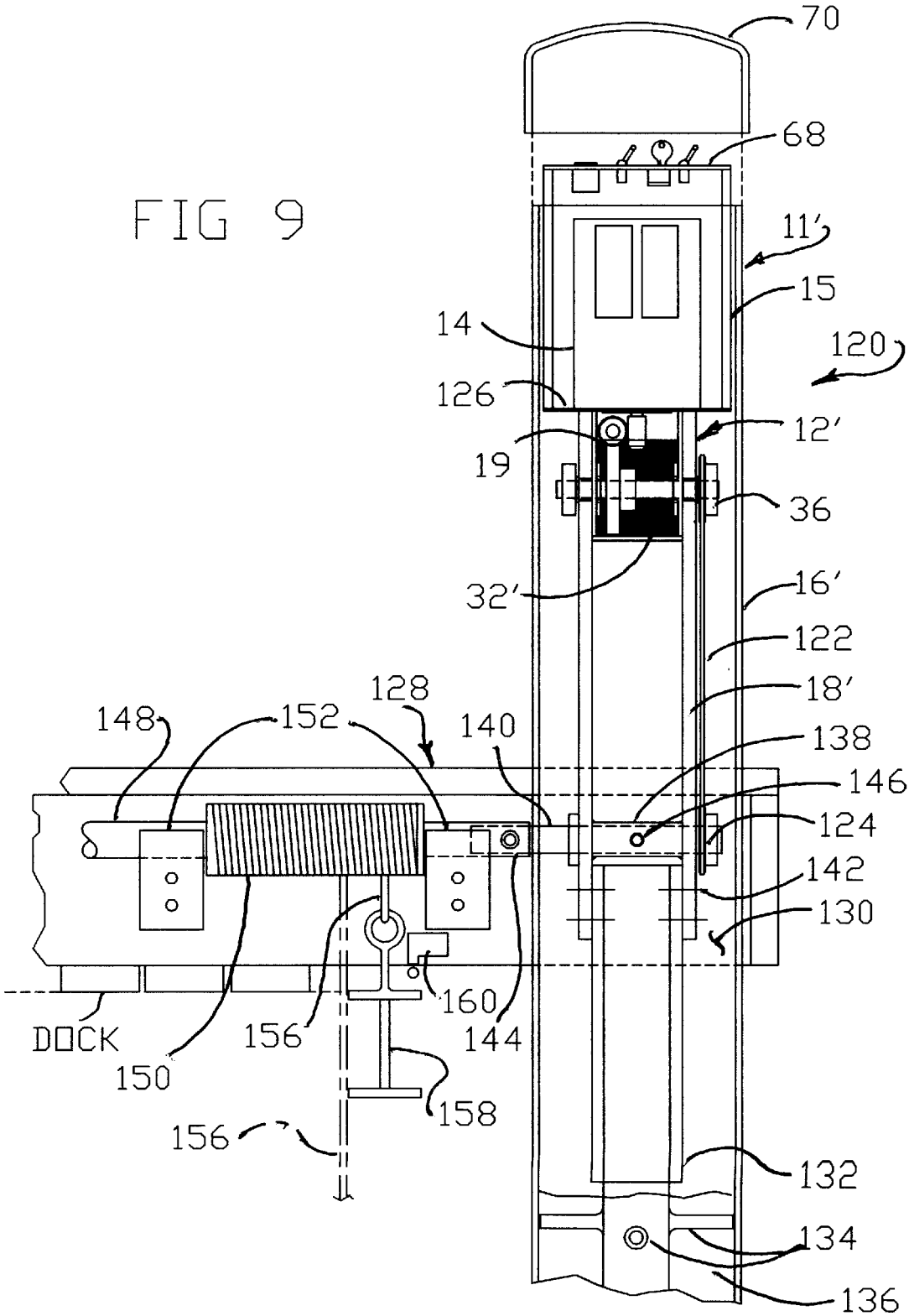
FIG. 9 is a front elevation schematic view of another embodiment of the invention incorporating a conventional cable drum arrangement which is positioned exterior to the hollow tubular piling and incorporated into a two-piling boat lift arrangement.

Referring now to FIG. 9, an alternate embodiment of a boat lift system is there shown generally at numeral 120 and, as in FIG. 1A, incorporates pvc tubular plastic pilings 16' which are embedded into the bottom of a body of water and reinforced with poured concrete 136 as previously described. This embodiment 120 includes a drive assembly 12' with drive motor 14 which is centered within piling 16' by a rigid plate 126. The drive motor 14 is operably connected to the dual worm gear arrangement within the gearbox 19 in a manner previously described. Oil reservoir 32' insures that all worm gear and bearing components within gearbox 19 are preferably immersed in oil for maximum efficiency and longevity.

The motor 14 is held within the tubular piling 16' by rigid plate 126 which, in turn, is held by gearbox 19. The gearbox 19 is, itself supported by rigid connection between two spaced apart elongated plates 18' which extend downwardly to support an output shaft 140 horizontally disposed and held for rotation only between these elongated plates 18'. Rotational output of the worm gear arrangement is transferred from pulley 36 to endless chain 122 into pulley 124 rigidly connected to the output shaft 140.

The lower ends of the elongated plates 18' are rigidly fastened by bolts at 142 for support just below the transverse output shaft 140 to mating 5" square tubing member 132 which is embedded in concrete. Member 132. is elongated to extend into the concrete fill area 136 and is self-centering within the outer tubular piling 16' by centering pins 134 which hold the square tubing 132 in generally coaxial alignment with the outer tubular piling 16' while the concrete fill 136 is poured and hardens.

This embodiment 120 also provides a conventional cable drum 150 which is mounted on shaft 148 coaxially with output shaft 140 by coupling 144 and locking pin 146. This cable drum 150 is rigidly connected to an upper transverse boat lift support beam shown generally at 128. Spaced wood bearing blocks 152 support each end of shaft 148 of the cable drum 150.

Travel sensors 160 are provided for each cable drum 150 which senses the vertical proximity of I-beams 158 which serve to support and lift a boat (not shown) placed upon a boat cradle (not shown) which is transversely supported between cable 156 and corresponding cable drum and cable positioned adjacent the other piling (not shown) of the boat lift system 120. When beam 158 reaches the predetermined upper limit, the travel sensor 160 interrupts power to the motor 14 via control panel 68.

Figure 10:
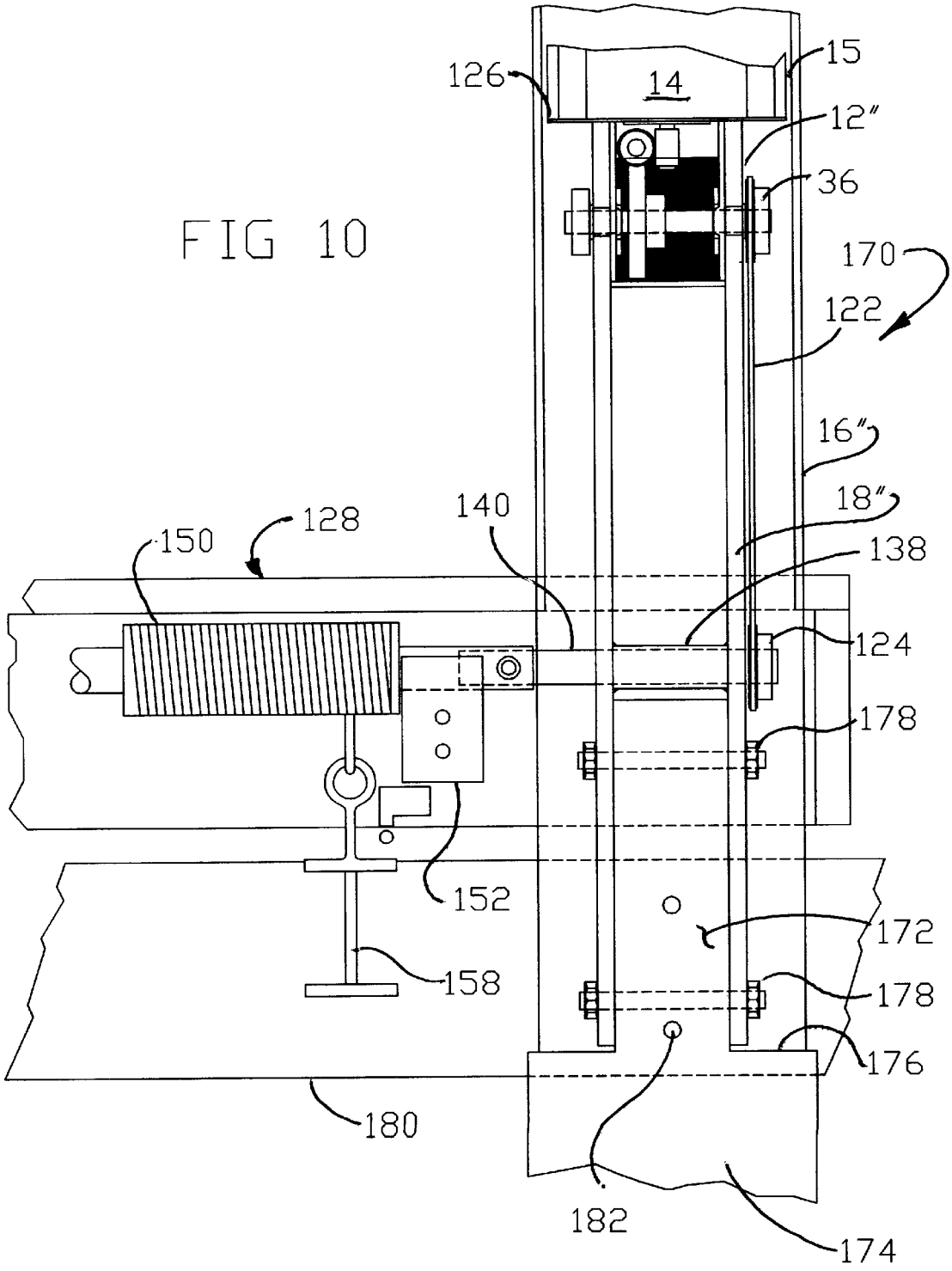
FIG. 10 is a front elevation schematic view of still another embodiment of the invention utilizing a conventional wooden piling for support and incorporated into a two-piling boat lift arrangement.

Referring now to FIG. 10, another embodiment of a boat lift system is there shown generally at numeral 170 and is adapted to be connected to the upper end 172 of an existing piling 174. The upper end 172 has been reduced in size to be boltably connected to the lower ends of spaced elongated support plates 18" by thru-bolt arrangements 178. The piling upper end 172 is rigidly connected to transverse stringer 180 by bolts at 182.

This embodiment 170 is substantially similar to that previously described in FIG. 9, therefore, except with respect to the interengagement of the upper end 172 of the wooden piling 174 and that tubular piling 16" terminates atop surface 176. Like members correspond to the components described previously in that FIG. 9.

Figure 12:
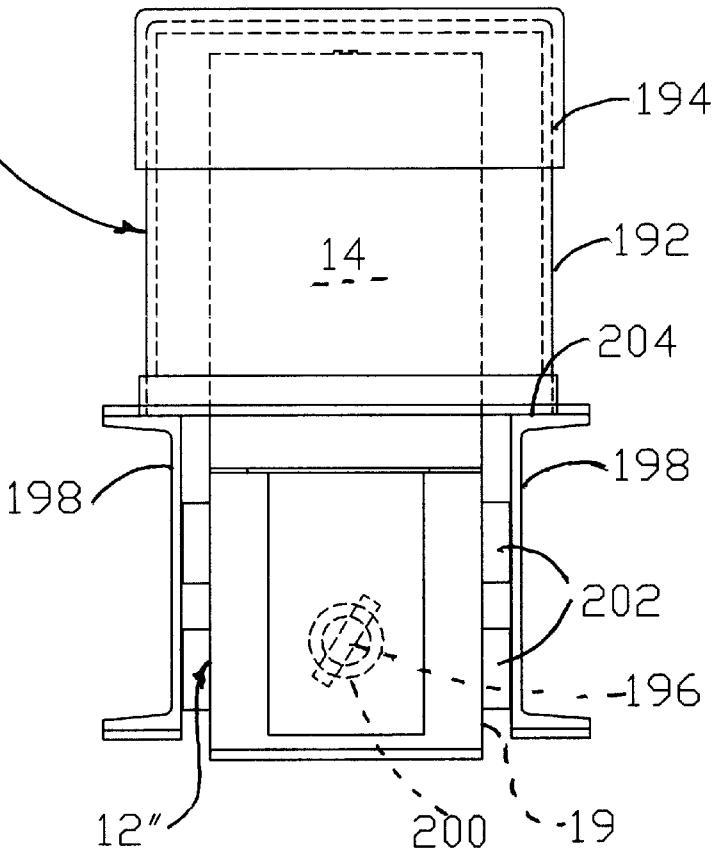
FIGS. 11 and 12 are front and side elevation schematic views, respectively, of still another embodiment of the invention shown connected atop an existing rail-type boat lift.
Figure 11:
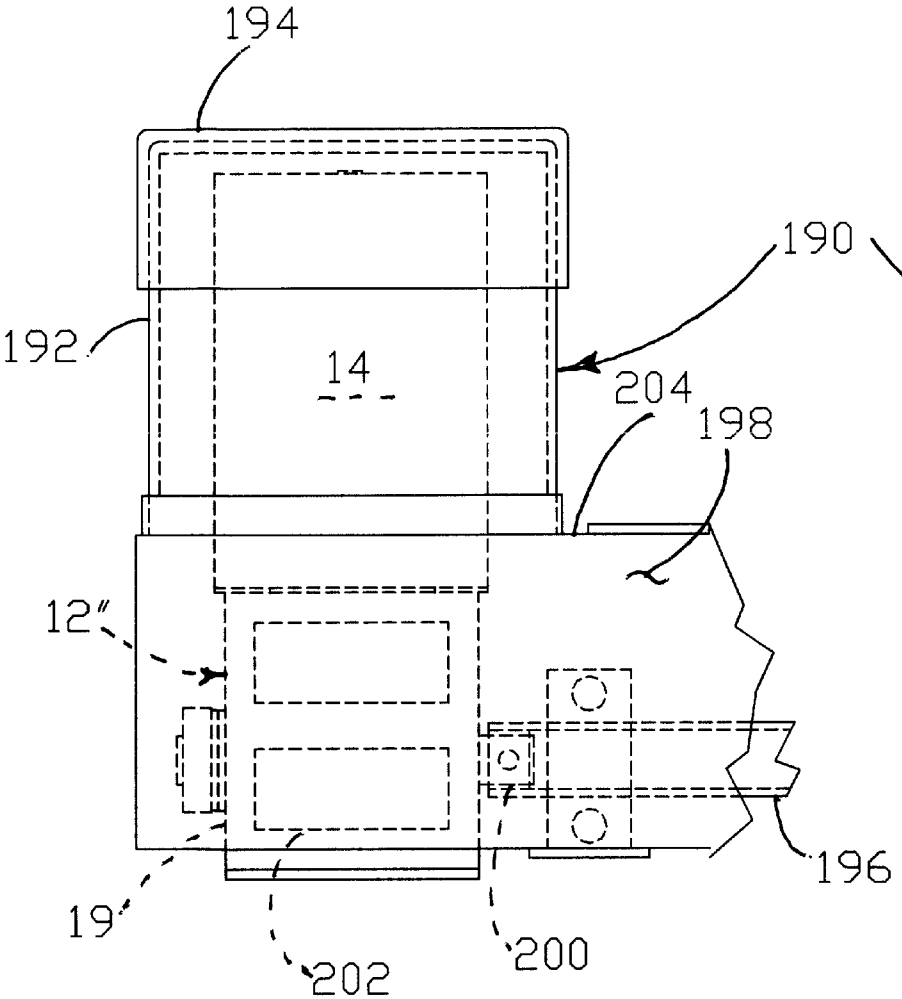

Referring now to FIGS. 11 and 12, another embodiment of a boat lift drive assembly is there shown generally at numeral 190 and is adapted to be utilized in conjunction with an existing rail-type boat lift (not shown), a portion of which includes existing overhead spaced channel beams 198. This embodiment 190 includes a drive motor 14 positioned within a tubular plastic housing 192 and enclosed by a pvc cover 194 in a fashion as previously described. The tubular housing 192 is supported atop surface 204 of the overhead beams 198. The drive apparatus 12", substantially as previously described, is positioned between the inner opposing surfaces of the existing channel members 198. Steel or UHMW plastic (ultra-high molecular weight) slide blocks 202 are positioned between the sides of the gear assembly 12" and the inner surfaces of channel members 198 to permit precise alignment of the gear assembly 12" and motor 14 to shaft 196. By allowing the gear assembly 12" to slidably "float" vertically between the beams 198, greater power transfer efficiency by precise alignment with shaft 196 is achieved.

The output shaft 200 is shown connected to shaft 196 which is a part of an existing cable drum assembly as previously described in FIGS. 9 and 10 and supports the gearbox motor. By this arrangement, this embodiment 190 of the invention is easily adapted to virtually any existing or new rail-type boat lifts.

Figure 13:
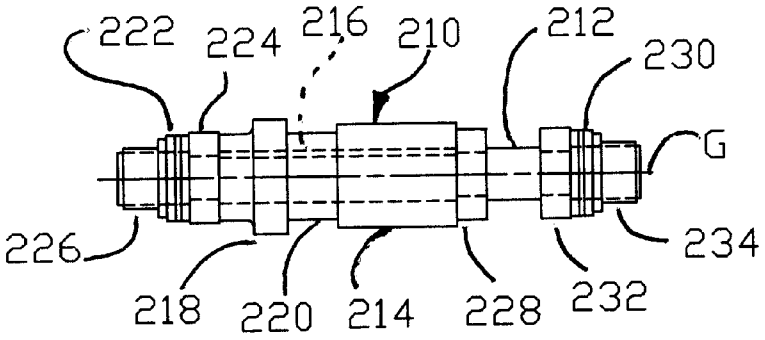
FIGS. 13 and 14 are side elevation assembled and exploded views, respectively, of the preferred embodiment of the worm gear/support shaft arrangement of the invention.
Figure 14:
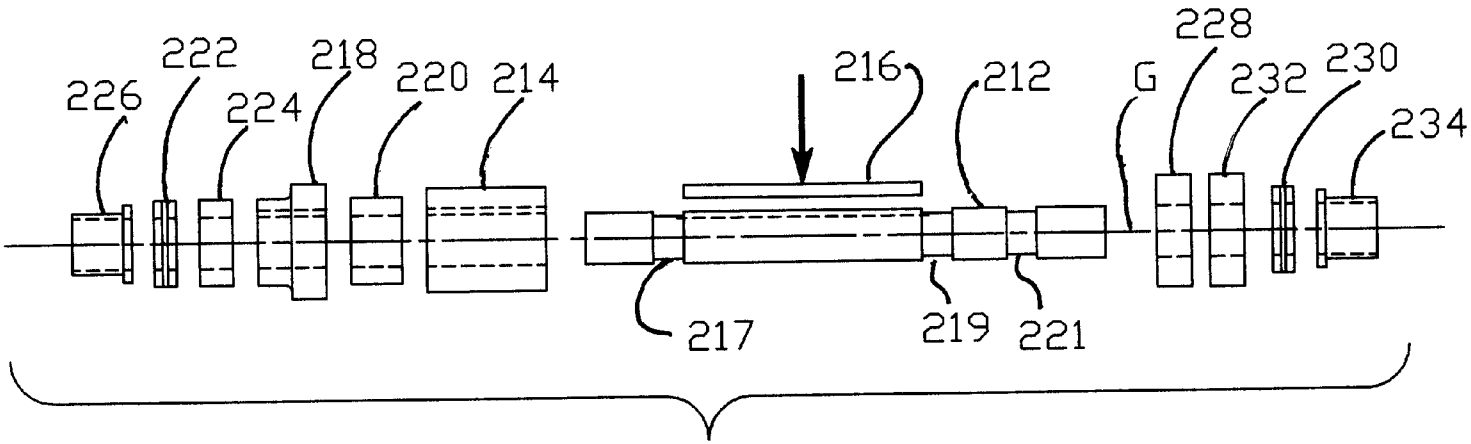

Referring now to FIGS. 13 and 14, the preferred embodiment of the high speed shaft assembly of the drive apparatus 12, 12' and 12" is shown generally at numeral 210. This shaft assembly 210 includes an elongated main shaft 212 mounted within the frame (not shown) about rotational axis G as previously described in relation to the output shaft of the drive motor (not shown).

Worm gear 218 is a 12-pitch/20-tooth worm gear which operates with a mating worm with one, two or four starts yielding respective reductions of 20, 10 or 5 to one. A two-piece clamp-on collar 224 clamped onto the shaft 212 at recess 217 and establishes the left-hand positioning of worm gear 218. A three-part needle bearing arrangement 222 bearing between collar 224 and a flange bearing 226 matably engaged into one side of the drive housing (not shown) absorbs axial thrust toward the left of the main shaft assembly 210 as viewed.

A spacer 220 bears against the worm gear 218 and against the worm 214 which, in the preferred embodiment is 8-pitch. This worm 214 is operably engaged into the second worm gear 30 (not shown) as best seen in FIGS. 4A and 4B. A square drive key 216 is mechanically engaged into a corresponding longitudinal groove formed into the main drive shaft 212 so as to operably connect the worm 214, spacer 220 and worm gear 218. Another two-piece clamping collar 228 is positioned against the other end of the worm 214 and sets in shaft recess 219 so as to maintain precise axial positioning of the worm 214. A third two-part clamping collar 232 is also inserted in recess 221 to maintain the axial positioning of another thrust washer assembly 230 which bears against the flange bearing 234 disposed at the right hand of the main shaft assembly 210 as viewed and operably engages within the opposite side panel of the drive frame (not shown).

An important aspect of this preferred embodiment 210 is to provide for the complete absorption of axial thrust generated along and orthogonal to rotational axis G as previously described so as to avoid any binding or power output reduction.

Figure 15:
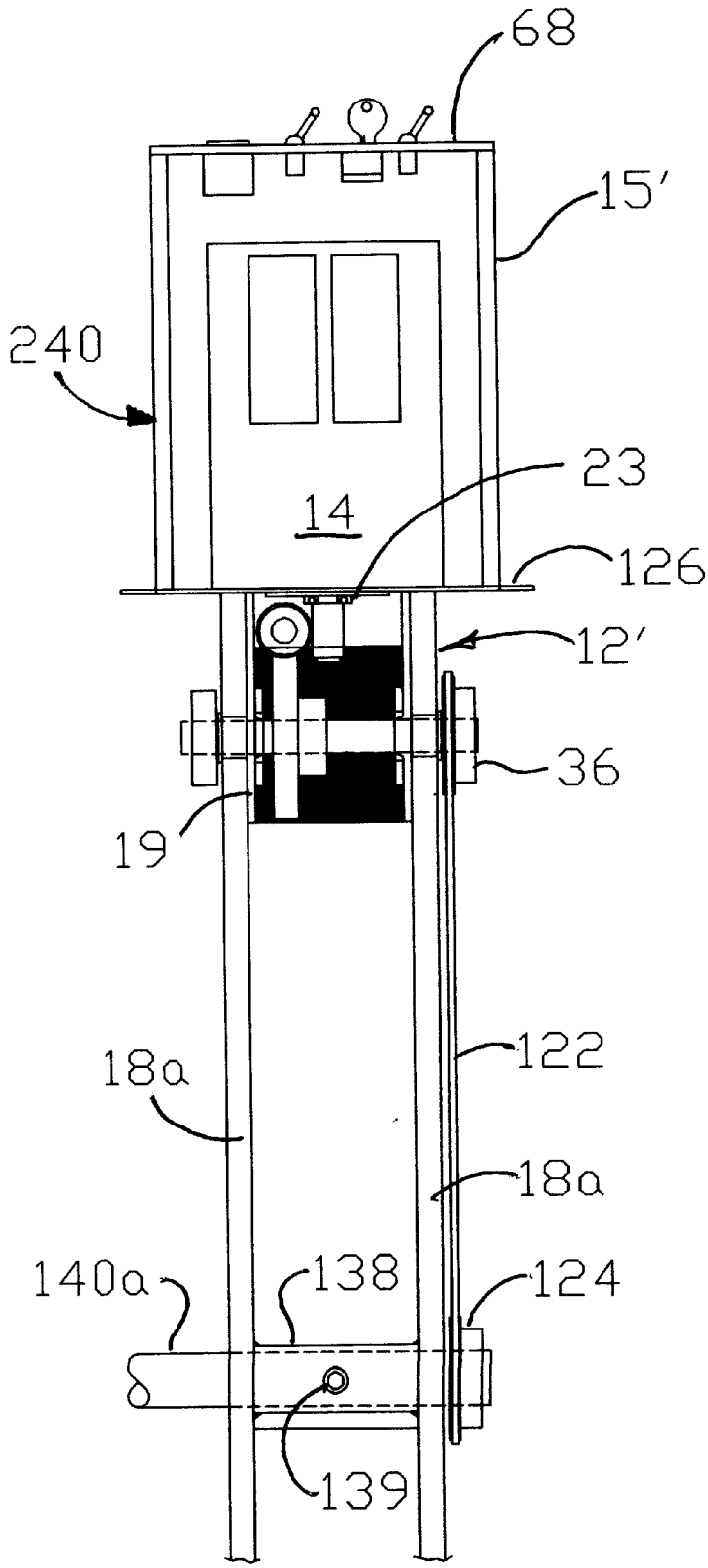
FIG. 15 is a simplified elevation view of the in-tubular-piling embodiment of the invention utilizing a conventional drive tube cable winder.

Referring now to FIG. 15, another broad embodiment of a boat lift drive assembly is there shown generally at numeral 240. In specific terms, this broad embodiment 240, which does not include a cable drum assembly, has previously been described with respect to FIGS. 9 and 10. This drive assembly 240 includes the drive motor 14 and tubular support rods 15' for supporting control panel 68. Mounting plate 126 is disposed between and connected to the lower end of the motor 14 and gearbox 19 and is supportively connected against the upper ends of elongated spaced plates 18*a* of the drive assembly 12'. Output sprocket 36 is operably engaged with endless chain 122 which drivingly rotates sprocket 124 rigidly connected to one end of a brass tubular member 138 held for rotation between plates 18*a*. The output shaft 140*a* is interconnected with tubular member 138 by pin 139. As previously described, the lower ends of plates 18*a* extend downwardly and are configured for secure attachment either to a wood piling or square tubing embedded in concrete inside a pvc piling.

Figure 16:
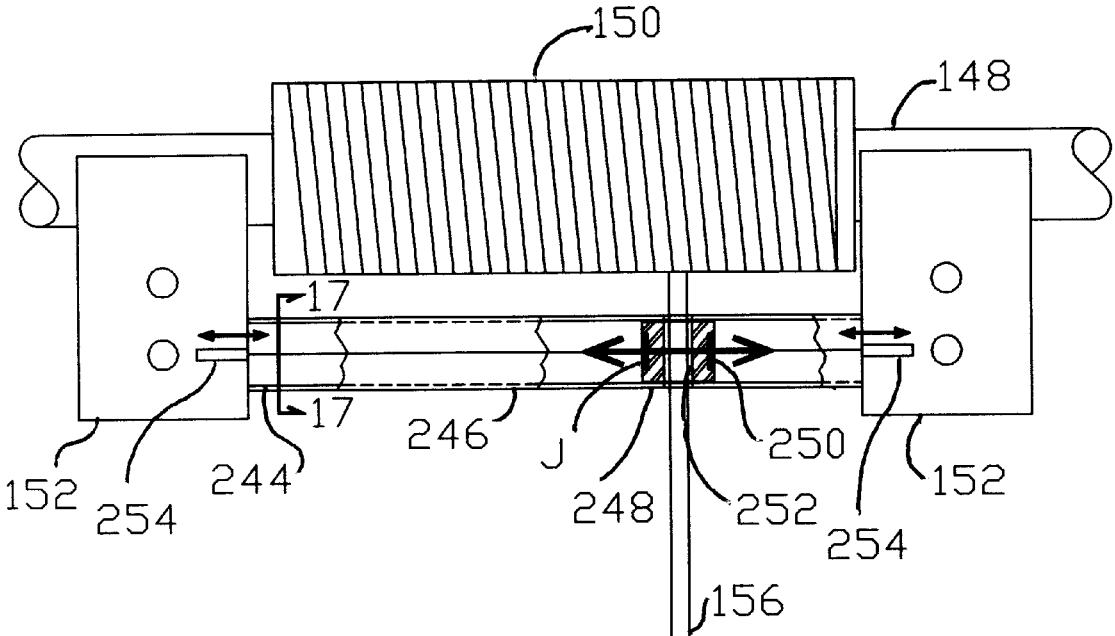
FIG. 16 is a schematic elevation view of an external cable drum including an auto shut-down at extreme cable travel.
Figure 17:
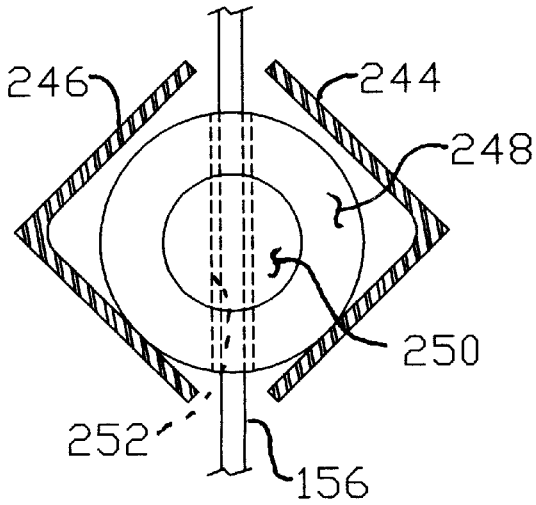
FIG. 17 is a section view in the direction of arrows 17—17 in FIG. 16.

Now referring to FIGS. 16 and 17, an automatic shutdown arrangement for cable drum 150 as previously described as being drivingly engaged over shaft 148 is there shown. As previously described, the support shaft 148 is mounted rigidly by bearing blocks 152 to the boat lift overhead support beam (not shown). Cable 156, extending downwardly from cable drum 150, attaches to and vertically positions the longitudinal support beam for each boat cradle (not shown).

As the cable 156 is extended or retracted, a follower 248 slidably engaged within opposing elongated angle members 244 and 246, is slidably moved correspondingly in the direction of arrow J. The cable 156 is engaged through aperture 252 of follower 248 and, when either of the rare earth magnets 250, disposed at each end face of the follower 248, come in close proximity to one of the reed switches 254 connected to bearing blocks 152, power to the drive motor is disconnected. Exact positioning of each reed switch 264 is accomplished by sliding movement in the direction of the arrows, each reed switch 254, once adjustably positioned, then rigidly secured to angles 244 and 246.

Figure 18:
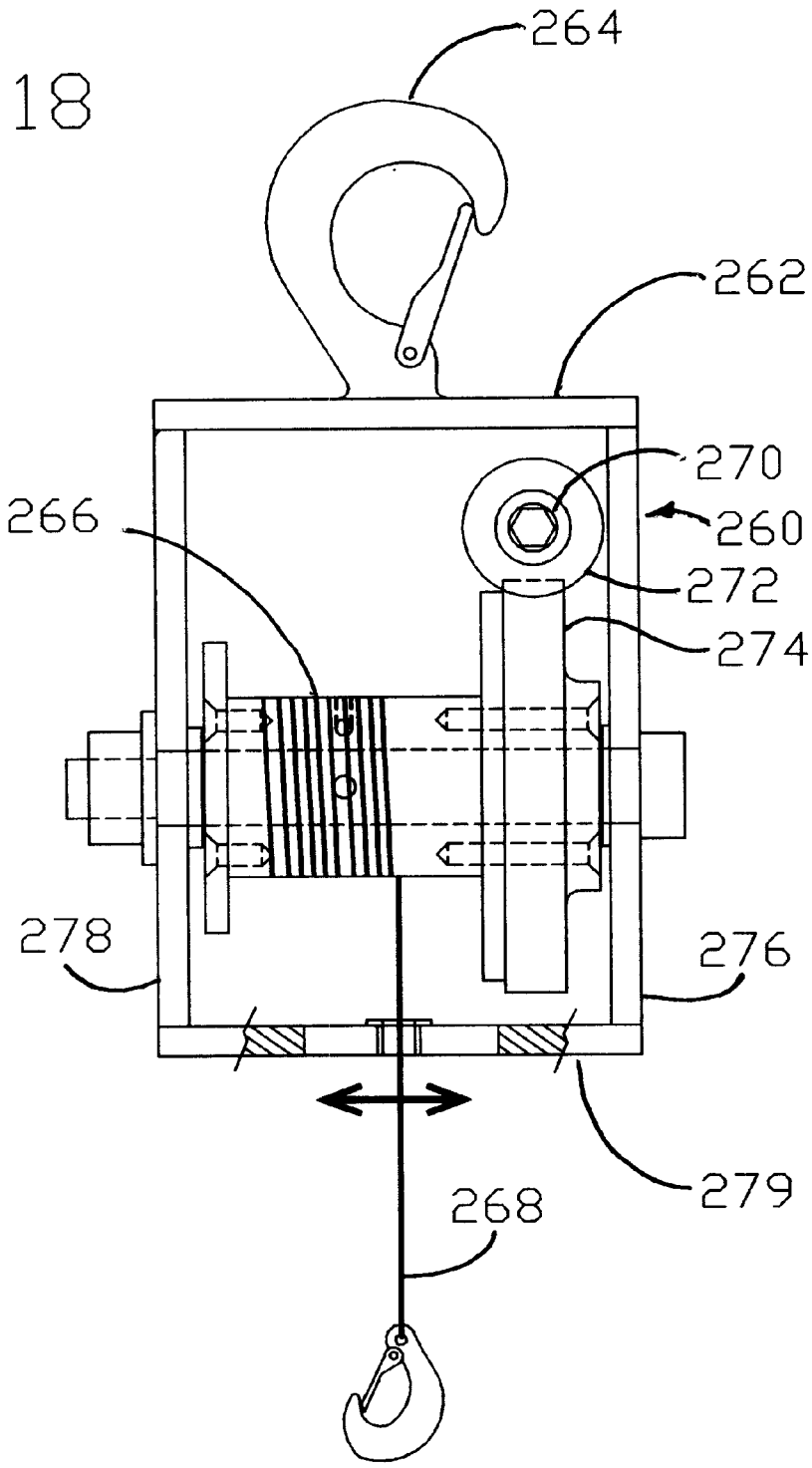
FIG. 18 is an elevation schematic view of a portable embodiment of the invention.

Referring now to FIG. 18, a portable adaptation of the present invention is there shown generally at numeral 260 and includes a drive housing having side panels 276 and 278, a top panel 262 to which a hanger hook 264 is attached and a lower panel 279 through which a movable cable 268 having a hook disposed at a distal lower end thereof is provided. A cable drum 266 is operably mounted for rotation only between side panels 276 and 278. Disposed coaxially at one end of the cable drum 266 is a worm gear 274 operably engaged with a worm 272. The worm 272 is held for rotation only between end panels (not shown for clarity) and is drivingly rotated by the use of a separate battery powered drill motor which will drivingly engage into socket 270. By this arrangement 260, an economical portable worm gear hoist is provided which does not include a drive motor, but rather relies upon the rotary power output from a separate battery powered drill.

Figures 19, 20, 21:
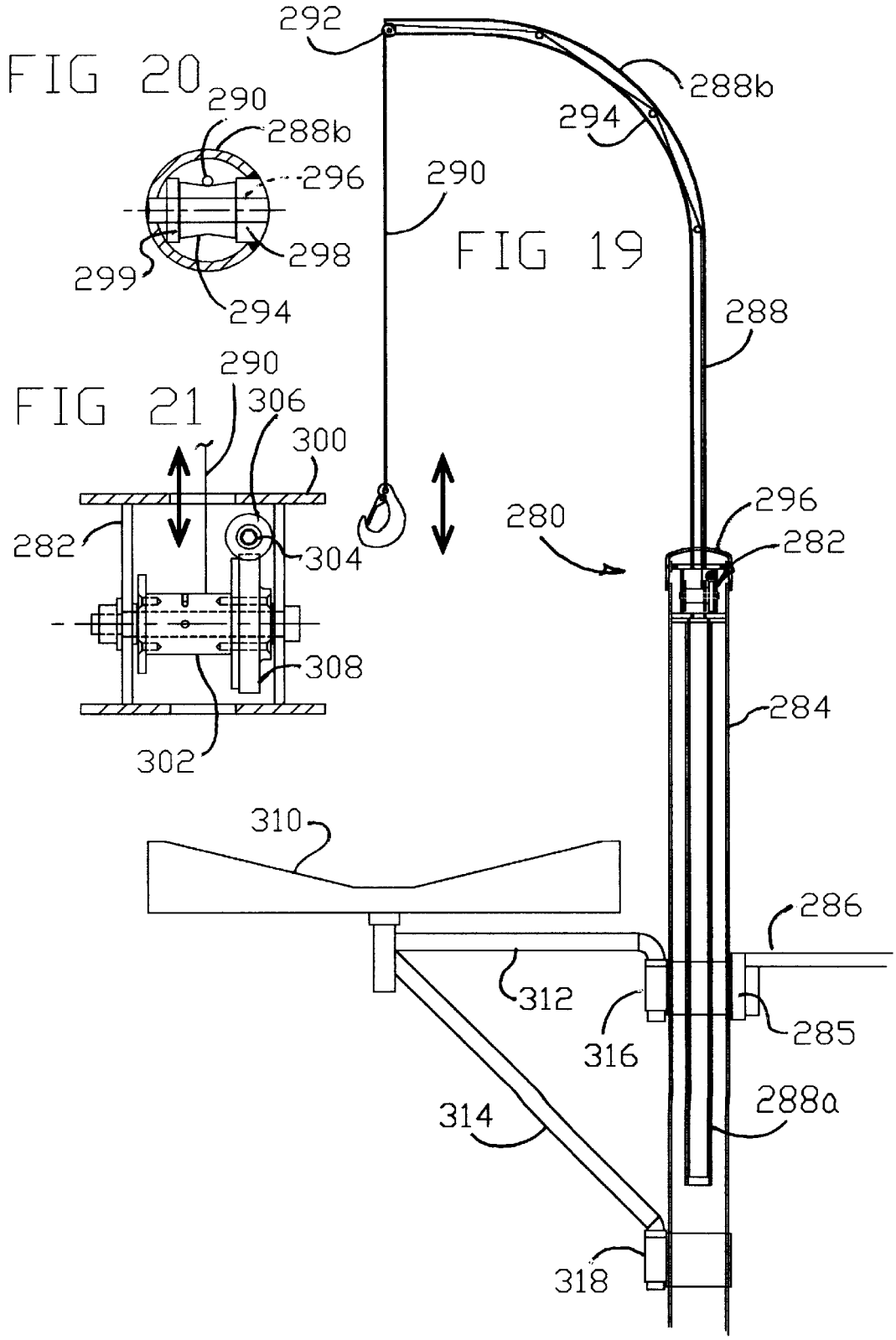
FIGS. 19 to 21 are schematic elevation and enlargement views of a davit embodiment of the invention.

Referring lastly to FIGS. 19 to 21, a davit embodiment of the invention is there shown generally at numeral 280. This davit assembly 280 includes an upright elongated tubular pvc piling 284 which is operably connected to an upright elongated facing member 285 of a horizontal deck 286 and an elongated metal or steel tubular member 288 which is rigidly held for rotation only along its lower portion 288*a* within the upright tubular piling 284. The exposed upper portion 288*b* of the tubular member 288 is arcuately formed as shown so as to laterally dispose a distal pulley 282 which rollably supports a lifting cable 290 as it exits from within the hollow tubular support member 288*b*.

As seen in FIG. 21, the lifting cable 290 is operably engaged around a cable drum 302 which is held for rotation only between the upright plates of a drive housing 282. As previously described in FIG. 18, a worm gear 308 is coaxially mounted adjacent one end of the cable drum 302 which is rotatably driven by worm 306, again the worm 306 being rotatably driven itself by the releasable engagement of a hexagonal drive shaft (not shown) of a conventional battery powered drill (not shown).

As seen in FIG. 20, the lifting cable 290 extends through the arcuate shape of hollow tubular member 288*b* in friction-free fashion over the concaved spool 294 held for rotation only about shaft 296 between bearing blocks 298 and 299.

By this arrangement, a davit of substantial lifting capability afforded by the utilization of a worm and worm gear arrangement is provided without the need and expense of a separate drive motor, that function being performed by a separate readily available battery powered drill motor. Note that an optional pivotable boat support 310 having support members 312 and 314 pivotally connected at 316 and 318 may also be provided.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A boat lift apparatus connectable to an elongated tubular piling, a lower portion of which receives support when embedded into a bottom of a body of water, comprising:

a motor connected to a gearbox and having an output shaft extending into said gearbox;

a first worm gear arrangement including a first worm, a first worm gear and a first support shaft, said first worm rigidly connected coaxially to said output shaft and drivingly engaged with said first worm gear which is rigidly connected on said first support shaft, a rotational axis of said first support shaft oriented orthogonally to a rotational axis of said output shaft;

a second worm gear arrangement including a second worm, a second worm gear and a second support shaft, said second worm spaced from said first worm gear and rigidly connected on said first support shaft, said second worm drivingly engaged with said second worm gear, said second worm gear rigidly connected on said second support shaft, a rotational axis of said second support shaft oriented orthogonally to a rotational axis of said first support shaft;

an elongated frame connected to said gearbox;

a cable drum having a length of cable and mounted for rotation on a third support shaft connected to said frame, said third support shaft substantially parallel with said second support shaft;

said cable drum operably connected to, and rotationally driven by, said second support shaft responsive to rotational output of said output shaft to withdraw and extend said cable on said cable drum.

2. A boat lift apparatus as set forth in claim 1, wherein:

a longitudinal axis of said output shaft is upright when said apparatus is in use.

3. A boat lift apparatus as set forth in claim 1, wherein:

a longitudinal axis of said output shaft is oriented between a substantially upright and a substantially horizontal orientation when said apparatus is in use.

4. A boat lift apparatus as set forth in claim 1, further comprising:

a thrust bearing positioned between said motor and said first worm for minimizing axial thrust transfer from said first worm to bearings of said output shaft in said motor.

5. A boat lift apparatus connected within an upper portion of an elongated tubular piling, a lower portion of said tubular piling receiving support when embedded into a bottom of a body of water, comprising:

said tubular piling;

a gearbox;

a motor having an output shaft and connected to said gearbox, said output shaft extending into said gearbox;

a first worm gear arrangement including a first worm, a first worm gear and first support shaft, said first worm rigidly connected coaxially on said output shaft and drivingly engaged with said first worm gear which is rigidly connected on said first support shaft, a rotational axis of said first support shaft oriented orthogonally to a rotational axis of said output shaft;

a second worm gear arrangement including a second worm, a second worm gear and second support shaft, said second worm spaced form said first worm gear and rigidly connected on said first support shaft, said second worm drivingly engaged with said second worm gear, said second worm gear rigidly connected on said second support shaft, a rotational axis of said second support shaft oriented orthogonally to a rotational axis of said first support shaft;

an elongated frame connected to said gearbox;

a cable drum having a length of cable and mounted for rotation on a third support shaft connected to said frame, said third support shaft substantially parallel with said second support shaft;

said cable drum operably connected to, and rotationally driven by, said second support shaft responsive to rotational output of said output shaft to withdraw and extend said cable on said cable drum.

6. A boat lift apparatus as set forth in claim 5, wherein:

a longitudinal axis of said output shaft is upright when said apparatus is in use.

7. A boat lift apparatus as set forth in claim 5, wherein:

a longitudinal axis of said output shaft is oriented between a substantially upright and a substantially horizontal orientation when said apparatus is in use.

8. A boat lift apparatus as set forth in claim 5, further comprising:

a thrust bearing positioned between said motor and said first worm for minimizing axial thrust transfer from said first worm to bearings of said output shaft in said motor.

9. A boat lift apparatus connectable to an elongated tubular piling, a lower portion of which receives support when embedded into a bottom of a body of water, comprising:

a gearbox;

a motor connected to said gearbox and having an output shaft extending into said gearbox;

a first worm gear arrangement including a first worm, a first worm gear and a first support shaft, said first worm rigidly connected coaxially on said output shaft and drivingly engaged with said first worm gear which is rigidly connected on said first support shaft, a rotational axis of said first support shaft oriented orthogonally to a rotational axis of said output shaft;

a second worm gear arrangement including a second worm, a second worm gear and a second support shaft, said second worm spaced from said first worm gear and rigidly connected on said first support shaft, said second worm drivingly engaged with said second worm gear, said second worm gear rigidly connected on said second support shaft, a rotational axis of said second support shaft oriented orthogonally to a rotational axis of said first support shaft;

an elongated frame connected to and extending from said gearbox;

two cable drums each having a length of cable and mounted for rotation at each end of a third support shaft connected to said frame, said third support shaft substantially parallel with, and spaced below said second support shaft;

each said cable drum operably connected to, and rotationally driven by said second support shaft responsive to rotational output of said output shaft to uniformly withdraw and extend said cable on each said cable drum, said cable drums offset horizontally from one another whereby said cables extending downwardly from each said cable drum are spaced apart to prevent contact therebetween during operation of said apparatus.

10. A boat lift apparatus as set forth in claim 9, wherein:

a longitudinal axis of said output shaft is upright when said apparatus is in use.

11. A boat lift apparatus as set forth in claim 9, wherein:

a longitudinal axis of said output shaft is oriented between a substantially upright and a substantially horizontal orientation when said apparatus is in use.

12. A boat lift apparatus as set forth in claim 9, further comprising:

a thrust bearing positioned between said motor and said first worm for minimizing axial thrust transfer from said first worm to bearings of said output shaft in said motor.

13. A boat lift apparatus, comprising:

an elongated tubular piling, a lower portion thereof receiving support when embedded into a bottom of a body of water;

a motor having an output shaft and a gearbox connected within an upper portion of said tubular piling;

a first worm gear arrangement positioned within said gearbox and including a first worm, a first worm gear and a first support shaft, said first worm rigidly connected coaxially on said output shaft and drivingly engaged with said first worm gear which is rigidly connected on said first support shaft, a rotational axis of said first support shaft oriented orthogonally to a rotational axis of said output shaft;

a second worm gear arrangement positioned within said gearbox and including a second worm, a second worm gear and a second support shaft, said second worm spaced from said first worm gear and rigidly connected on said first support shaft, said second worm drivingly engaged with said second worm gear, said second worm gear rigidly connected on said second support shaft, a rotational axis of said second support shaft oriented orthogonally to a rotational axis of said first support shaft;

two cable drums each having a length of cable and mounted for rotation at each end of a third support shaft mounted for rotation to said frame, said third support shaft substantially parallel with, and spaced below said second support shaft;

each said cable drum operably connected to, and rotationally driven by, said second support shaft responsive to rotational output of said output shaft to uniformly withdraw and extend said cable on each said cable drum;

said cable drums offset horizontally from one another whereby cable extending downwardly from each said cable drum are spaced apart to prevent contact therebetween during operation of said apparatus;

said cables extending downwardly from each said cable drum supportively engaged over separate turning pulleys, each said cable thereafter extending to a boat support dependently supported by said cables and vertically positionable by operation of said motor.

14. A boat lift apparatus as set forth in claim 13, wherein:

a longitudinal axis of said output shaft is upright when said apparatus is in use.

15. A boat lift apparatus as set forth in claim 13, wherein:

a longitudinal axis of said output shaft is oriented between a substantially upright and a substantially horizontal orientation when said apparatus is in use.

16. A boat lift apparatus as set forth in claim 13, further comprising:

a thrust bearing positioned between said motor and said first worm for minimizing axial thrust transfer from said first worm to bearings of said output shaft in said motor.

17. A boat lift drive apparatus connectable to an upper end of an elongated piling, a lower portion of which received support when embedded into a bottom of a body of water, comprising, a gearbox;

a motor connected to said gearbox and having an output shaft extending into said gearbox;

a first worm gear arrangement including a first worm, a fist worm gear and a first support shaft, said first worm rigidly connected coaxially on said output shaft and drivingly engaged with said first worm gear which is rigidly connected on said first support shaft, a rotational axis of said first support shaft oriented orthogonally to a rotational axis of said output shaft;

a second worm gear arrangement including a second worm, a second worm gear and a second support shaft, said second worm spaced from said first worm gear and rigidly connected on said first support shaft, said second worm drivingly engaged with said second worm gear, said second worm gear rigidly connected on said second support shaft, a rotational axis of said second support shaft oriented orthogonally to a rotational axis of said first support shaft;

an elongated frame connected to said gearbox;

a third support shaft connected to said frame, said third support shaft having a rotational axis which is substantially parallel with the rotational axis of said second support shaft, said third support shaft operably connected to, and rotationally driven by, said second support shaft responsive to rotational output of said output shaft;

one end of said third support shaft configured for connection to a boat lift cable drum having a length of cable wrapped thereon.

18. A boat lift drive apparatus connectable to a support member associated with a boat lift, comprising:

a gearbox;

a motor connected to said gearbox and having an output shaft extending into said gearbox;

a first worm gear arrangement operably connected within said gearbox and including a first worm, a first worm gear and a first support shaft, said first worm rigidly connected coaxially on said output shaft and drivingly engaged with said first worm gear which is rigidly connected on said first support shaft, a rotational axis of said first support shaft oriented orthogonally to a rotational axis of said output shaft;

a second worm gear arrangement including a second worm, a second worm gear and a second support shaft, said second worm spaced from said first worm gear and rigidly connected on said first support shaft, said second worm drivingly engaged with said second worm gear, said second worm gear rigidly connected on said second support shaft, a rotational axis of said second support shaft oriented orthogonally to a rotational axis of said first support shaft;

one end of said second support shaft configured for driving connection to a drive shaft of a boat lift cable drum having a length of cable wrapped thereon and having a distal end thereof connected to a boat cradle.

19. A boat lift drive apparatus as set forth in claim 18, wherein:

said support member includes two spaced apart support beams having parallel facing surfaces, said gearbox is held between said support beams and against said parallel surfaces for sliding translation only; and said gearbox is supportively held in cantilever fashion by the drive shaft of the cable drum.

* * * * *